United States Patent [19]

Schmid

[11] 4,106,404

[45] Aug. 15, 1978

[54] APPARATUS FOR SEPARATING LIQUIDS AND SOLIDS FROM ONE ANOTHER, ESPECIALLY FOR EXTRACTING JUICE FROM AGRICULTURAL PRODUCTS

[75] Inventor: Alfred Schmid, Niederweningen, Switzerland

[73] Assignee: Bucher-Guyer AG Maschinenfabrik, Niederweningen, Switzerland

[21] Appl. No.: 783,266

[22] Filed: Mar. 31, 1977

[30] Foreign Application Priority Data

Apr. 7, 1976 [CH] Switzerland ..... 4359/76

[51] Int. Cl.[2] ..... B30B 9/12; B30B 5/02

[52] U.S. Cl. ..... 100/117; 100/211

[58] Field of Search ..... 100/117, 211, 112, 104, 100/110, 116; 210/350, 351

[56] References Cited

U.S. PATENT DOCUMENTS

| | | | |
|---|---|---|---|
| 2,538,403 | 1/1951 | Watson | 100/211 |
| 2,882,815 | 4/1959 | Bernier | 100/211 X |
| 4,024,810 | 5/1977 | Braun | 100/211 X |

FOREIGN PATENT DOCUMENTS

| | | | |
|---|---|---|---|
| A67,166 | 6/1957 | France | 100/211 |
| 1,066,919 | 1/1954 | France | 100/211 |
| 977,234 | 7/1965 | Fed. Rep. of Germany | 100/211 |

*Primary Examiner*—Stanley N. Gilreath
*Attorney, Agent, or Firm*—Werner W. Kleeman

[57] ABSTRACT

An apparatus for separating liquid and solid materials from one another, especially for the extraction of juice from agricultural products, particularly from fruit, comprising a rotatably mounted press container which is subdivided by a substantially hood-shaped press or squeezing diaphragm into a pressure compartment and a press or squeezing compartment. The pressure compartment possesses an inlet arrangement for the infeed of a pressurized fluid medium and the squeezing compartment is provided with a juice outlet arrangement. At the region of the squeezing diaphragm there are provided outfeed or ejection elements for the product residues, these ejection elements being dispositioned to protrude into the squeezing compartment and extend along sections of a helical or screw line.

11 Claims, 5 Drawing Figures

Fig. 2
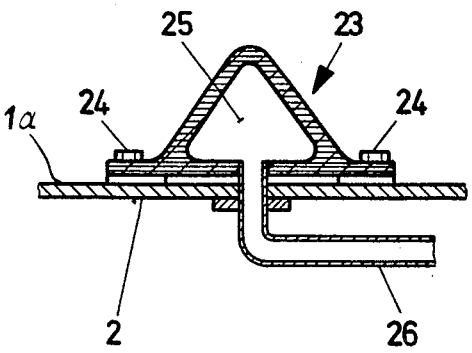
Fig. 3
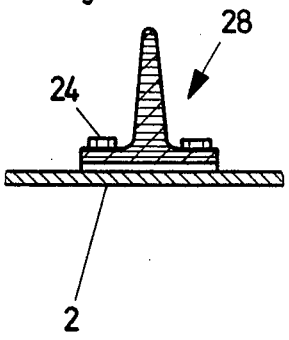
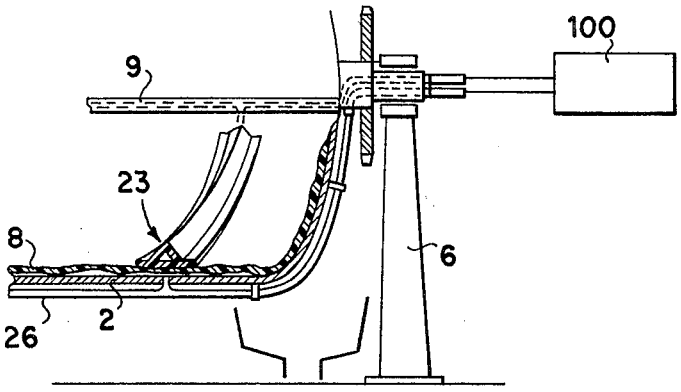
Fig. 4
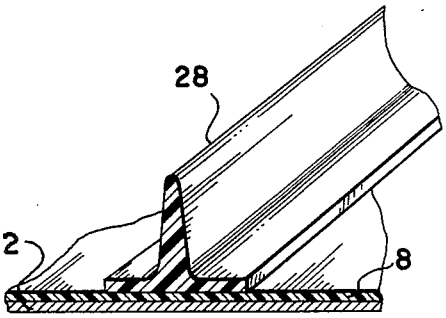
Fig. 5

APPARATUS FOR SEPARATING LIQUIDS AND SOLIDS FROM ONE ANOTHER, ESPECIALLY FOR EXTRACTING JUICE FROM AGRICULTURAL PRODUCTS

BACKGROUND OF THE INVENTION

The present invention relates to a new and improved construction of apparatus for the separation of liquids and solids from one another, especially for extracting juice from agricultural products, predominantly fruit, which apparatus is of the type comprising a rotatably mounted press container which is internally subdivided by a substantially hood-shaped press or squeezing diaphragm into a pressure compartment and a squeezing compartment, the pressure compartment being equipped with an inlet arrangement for a pressurized fluid medium (as such term is later defined herein), and the squeezing compartment is equipped with a juice outlet arrangement.

SUMMARY OF THE INVENTION

It is a primary object of the present invention to provide a new and improved construction of apparatus for separating liquids and solids from one another, especially for the removal of juice from agricultural products, in an extremely efficient and reliable manner.

Another significant object of the present invention aims at the provision of apparatus for extracting juice from agricultural products, especially fruit, which is equipped with means insuring for essentially complete carry-out from the internal confines of the press container the product residues following the juice extraction operation.

Now in order to implement these and still further objects of the invention, which will become more readily apparent as the description proceeds, the juice extraction apparatus of the present invention contemplates providing an arrangement for ejecting or conveying out of the squeezing or press compartment the product residues as completely as possible and without any side effects. To that end, the inventive apparatus is equipped with outfeed or ejection elements at the region of the squeezing diaphragm. These ejection elements protrude into the press or squeezing compartment and extend along sections of a substantially helical or screw line.

By virtue of the arrangement of ejection elements at the region of the squeezing diaphragm this previously neutral region in terms of emptying of the press container, now can be activated i.e., rendered functional. This is in contrast to those prior art constructions where ejection elements were arranged at other regions of the press container, since with the inventive solution it is possible to thereby prevent entrapment of the product residues between neighboring ejection elements and thus impairing their functionality. With the aid of the squeezing diaphragm it is actually possible to easily detach any residues which may have undesirably become entrapped or stuck between or at the outfeed or ejection elements.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 illustrates in fragmentary cross-sectional view details of a support element for an associated product outfeed or ejection element, which support element is here shown as a hollow body member;

FIG. 3 illustrates, likewise in cross-sectional view, a modified construction of a support element for an associated product or outfeed ejection element, wherein the support element here possesses a solid profile or sectional shape;

FIG. 4 is a fragmentary cross-sectional view, similar to the showing of FIG. 3, wherein however an ejection element, like the support element of FIG. 3 is mounted directly at the squeezing diaphragm; and FIG. 5 is a fragmentary sectional view, similar to the showing of FIG. 1, illustrating an ejection element, like the support element of the showing of FIG. 2, mounted directly at the squeezing diaphragm.

DETAILED DESCRIPTION OF THE PREFERRED EMBODIMENTS

Figure 1:
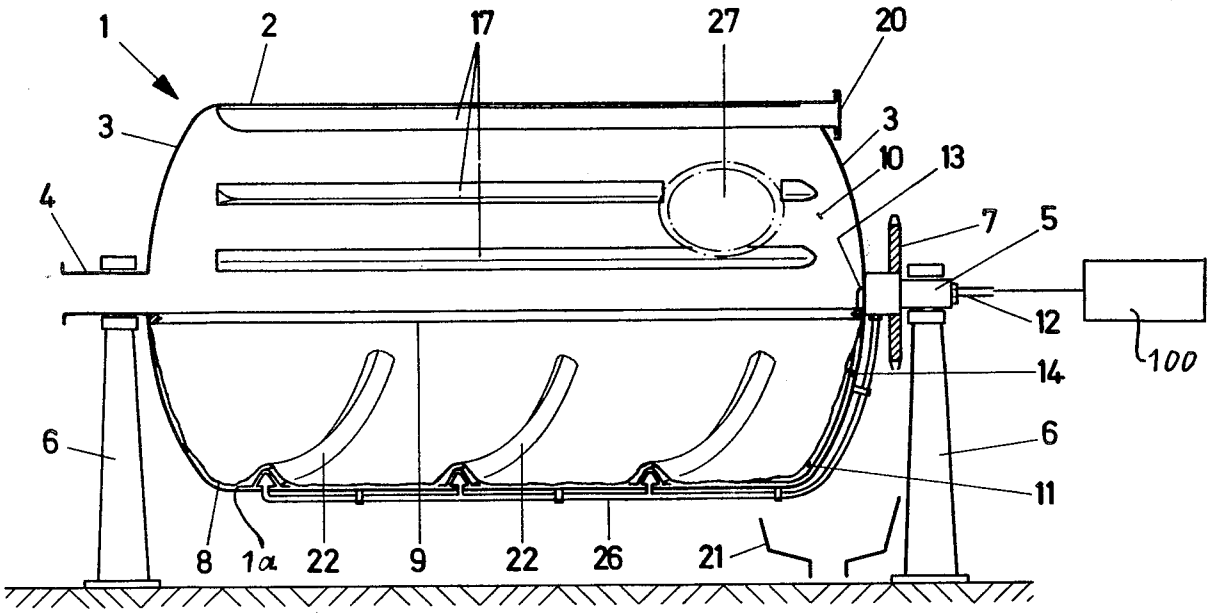
FIG. 1 is an axial sectional view of a juice extracting apparatus constructed according to the present invention and equipped with a substantially cylindrical press container.

Describing now the drawings, the exemplary embodiment of juice extraction apparatus depicted in FIG. 1 will be seen to comprise a press container 1 here shown as having a substantially cylindrical shell or jacket 2, although other configurations of the press container are possible. The press container 1 is closed at both of its extreme ends by curved or domed end walls 3. These end walls 3 are equipped with hollow axially protruding bearing journals or trunnions 4 and 5 which are rotatably mounted at the bearing or pillow blocks 6. A suitable drive, here shown as a gear 7, is rigidly connected for rotation with the hollow bearing journal 5 and serves to place into rotation the press container 1. The manner of driving the press container 1 is uncritical and does not constitute subject matter of the present invention, and thus, other forms of drive means can be obviously employed.

Now within the confines of the hollow press container 1 there is located a substantially hood-shaped press or squeezing diaphragm 8, the edge of which is sealingly anchored in any appropriate fashion at the immediate region of an axial plane of the press container 1 at the walls thereof, i.e., at the jacket or shell 2 and both of the end walls 3. This anchoring structure, which extends completely around the press container 1, has been generally indicated by reference character 9. By virtue of this arrangement the press container 1 is subdivided by means of the squeezing diaphragm 8 into a press or squeezing compartment 10 and a pressure compartment 11. This pressure compartment 11 communicates in a controlled or controllable manner by means of an inlet arrangement, generally indicated by reference character 12, — and which will be more fully described hereinafter — with a suitable source, generally indicated by reference character 100, for the infeed of a pressurized fluid medium. The expression "pressure" or "pressurized", as herein employed, is intended to signify both excess pressure as well as negative pressure, where appropriate, and it is thus contemplated to introduce the pressurized fluid medium into the pressure compartment 11 and to withdraw it from such pressure compartment. In one instance, the size of the pressure compartment 11l is increased at the expense of the press or squeezing compartment 10, and, in the other case, the squeezing diaphragm 8 is more or less placed against the inner wall of the container 1. The hollow journal or trunnion 5 serves as part of the inlet arrangement 12 and is connected by means of a by-pass arrangement or line 13 with at least one inlet line or conduit 14 bearing at the inside of the container wall 1*a*. The inlet line or conduit 14 is equipped with suitable recesses, such as not particularly illustrated holes and/or slots, through which the fluid medium can depart out of the line or conduit 14 into the pressure compartment 11. Details of such possible construction of the inlet line or conduit 14 constitutes subject matter of the commonly assigned, United States Patent application Ser. No. 752,668, filed Dec. 20, 1976, entitled "Apparatus For Separating Liquid And Solid Materials", the disclosure of which is incorporated herein by reference.

Apart from the infeed line or conduit 14 there will be noticed that extending from the hollow journal or trunnion 5 is a further infeed line or conduit 26 which leads to the support elements 23, the purpose of which arrangement will be discussed more fully hereinafter. At this point it is sufficient to recall that the source 100 is capable of furnishing, as desired, pressure and/or vacuum conditions. Hence, the source 100 may be constituted by conventional hardware suitable for this purpose. Typically, for instance, it may contain a vacuum pump and a pressure pump for exerting the respective suction and pressure conditions. Equally, it can be conceivably constituted by a suitable compressor, the inlet and outlet sides of which can be selectively operatively flow connected, as desired, with the infeed lines 14 and 26 to establish the requisite pressure conditions in such lines. While the foregoing typifies possible constructions of the source 100 it in no way exhausts the possibilities which can be conceivably used and are available on the market, and since the invention is not concerned with any specific construction of such unit, further details thereof are not necessary for understanding the principles of the invention.

Continuing, and again referring to FIG. 1, it will be seen that the juice outlet arrangement comprises a number of drainage channels 17, each of which possesses an outlet stud or connection 20, wherein only one is visible in the drawing to simplify its illustration. During rotation of the press container 1 the outlet studs 20 are dispositioned above a catch or collecting trough 21 or other suitable or equivalent structure. Preferred constructional forms of drainage channels 17 equally have been disclosed in the above-mentioned copending United States application Ser. No. 752,668.

Now in accordance with the invention, and as best seen by referring to FIG. 1, at the region of the squeezing diaphragm 8 there are provided a number of product residue outfeed or ejection elements, generally designated in their entirety by reference character 22, each such outfeed or ejection element 22 protruding into the squeezing compartment 10 i.e., extending in protruding fashion from the inner surface of the squeezing diaphragm 8. According to the exemplary embodiment shown in FIG. 2, each such ejection element 22 is provided with a support body 23 having a hollow profile or sectional shape so as to form an inner channel or chamber 25. These support bodies 23 are connected in suitable fashion, as shown here by way of example with the aid of screws 24 or equivalent structure, with the inner surface or wall 1*a* of the jacket or shell 2 of the press container 1. The inner space or chamber 25 of each support body 23 can be impinged with a pressurized fluid medium, such as compressed or pressurized air delivered by the source 100, through the line or conduit 26. As a result, it is possible to construct the support bodies 23 of a flexible material, for instance as hose-like or hose-shaped elements, since under the action of the pressurized fluid medium they attain their requisite rigidity or stiffness. The support bodies 23 are covered by the squeezing diaphragm 8 which, if desired, may advantageously be formed of a material which enables the squeezing diaphragm 8 to easily accommodate itself to the shape of the support bodies 23. Of course, the squeezing diaphragm 8 also could be appropriately profiled or shaped. In either case, it is possible to generate by means of the source 100 a negative pressure in the pressure compartment 11, so that the squeezing diaphragm 8 snuggly bears against the support bodies 23. The foregoing discussion is equally applicable to the modified construction of support body shown in FIG. 3, generally designated by reference character 28, and composed of a solid section or profile. Also these support bodies 28 (only one being shown in FIG. 3, but obviously a plurality would be used in correspondence to the number of ejection elements 22) also could be formed of a flexible material. Conversely, there can equally be used a rigid material.

In contrast to the illustrated exemplary embodiments of FIGS. 1 to 3, it is equally possible for elements, corresponding to the support bodies 23 or the support bodies 28, to be arranged at the squeezing diaphragm 8 instead of the jacket or shell 2 of the press container 1. In this case such elements 23 and 28 directly constitute the outfeed or ejection elements. Such arrangements have been shown in FIGS. 4 and 5. Specifically, FIG. 4 illustrates one of a number of ejection elements 28 directly mounted at the squeezing diaphragm 8 and constructed similar to the support body 28 shown in FIG. 3. FIG. 5 shows the squeezing diaphragm 8 provided with one of a number of hose-like ejection elements 23 in the form of hollow body members, again mounted directly at the squeezing diaphragm 8, and essentially corresponding in construction to the support element 23 shown in FIG. 2. The line 26 delivers pressurized air from the source 100 to the flexible hose-like ejection elements 23 mounted on the squeezing diaphragm 8. The ejection elements 22 can be anchored in any random suitable manner with the squeezing diaphragm 8, for instance by being vulcanized therewith. They have imparted thereto the requisite rigidity or stiffness for conveying out the product residues, in any event at such time when the squeezing diaphragm 8 is brought into contact with the wall 1*a* of the press container 1 by means of the negative pressure delivered to the pressure compartment 11 by the source 100. Independently thereof, ejection elements having a hollow section or shape can be reinforced or stiffened by the application of internal pressure to the interior of such hollow shaped ejection elements. Of course, the infeed of the pressurized fluid medium to such ejection elements would be preferably accomplished at the region of the anchoring structure 9 of the press or squeezing diaphragm 8.

With the embodiments disclosed herein the residues, as mentioned, can be completely ejected or carried out of the confines or interior of the press container 1 during the rotation thereof, with the aid of the ejection elements 22, the product residues being removed through the outlet opening or exit 27 of the container jacket or shell 2.

Possible materials which are particularly suitable — although others surely can be used — for forming the ejection elements are rubber and plastics.

Finally, the press container 1, while here shown as possessing a cylindrical configuration can contain different shapes and incorporate further modifications, of which certain more significant ones constitute the subject matter of the commonly assigned, copending United States application Ser. No. 783,265 filed Mar. 31, 1977, entitled "Apparatus For Separating Liquids And Solids", to which reference may be readily had and the disclosure of which is incorporated herein by reference.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for separating liquid and solid materials from one another, especially for the extraction of juice from agricultural products, in particular from fruit, comprising:

a press container;

means for rotatably mounting said press container;

a substantially hood-shaped squeezing diaphragm subdividing the press container into a pressure compartment and a squeezing compartment;

means defining an inlet arrangement for a pressurized fluid medium delivered to said pressure compartment;

means defining a juice outlet arrangement provided for said squeezing compartment;

a plurality of product residue-ejection elements arranged at the region of said squeezing diaphragm;

said ejection elements protruding into said squeezing compartment and extending along sections of a screw line.

2. The apparatus as defined in claim 1, wherein:

said ejection elements are carried out by said squeezing diaphragm.

3. The apparatus as defined in claim 2, wherein:

said ejection elements are formed of a flexible material.

4. The apparatus as defined in claim 3, wherein:

said ejection elements each comprise a hollow body member.

5. The apparatus as defined in claim 4, wherein:

said ejection elements comprise substantially hose-like structural elements; and means defining a source of compressed air with which said ejection elements can be connected.

6. The apparatus as defined in claim 1, wherein:

said press container includes inner wall means; p1 support body means provided for said ejection elements; and means for securing said support body means at said wall means of said press container.

7. The apparatus as defined in claim 6, wherein:

at least said support body means are formed of a flexible material.

8. The apparatus as defined in claim 7, wherein:

at least said support body means are each formed as a hollow body.

9. The apparatus as defined in claim 8, wherein:

at least said support body means comprise hose-like elements; and means defining a source of compressed air for said hose-like support body means.

10. The apparatus as defined in claim 1, further including:

means defining a source of negative pressure for said pressure compartment.

11. An apparatus for separating liquid and solid materials from one another, especially for the extraction of juice from agricultural products, in particular from fruit, comprising:

a press container;

means rotatably mounting said press container;

a substantially hood-shaped squeezing member subdividing the press container into a pressure compartment and a squeezing compartment;

means defining an inlet arrangement for a pressurized fluid medium delivered to said pressure compartment;

means defining a juice outlet arrangement provided for said squeezing compartment;

product residue-ejection means arranged at the region of said squeezing member; and said ejection means protruding into said squeezing compartment and extending along sections of a helical line.

* * * * *